US006024516A

United States Patent [19]

Taylor et al.

[11] Patent Number: 6,024,516

[45] Date of Patent: Feb. 15, 2000

[54] SYSTEM FOR SECURING A FACE PANEL TO AN EARTHEN FORMATION

[76] Inventors: Thomas P. Taylor, 2500 Cranberry La., Euless, Tex. 76039; William K. Hilfiker, 2202 Lakeridge Dr., Grapevine, Tex. 76051

[21] Appl. No.: 08/906,048

[22] Filed: Aug. 5, 1997

[51] Int. Cl.[7] ..... E02D 29/02

[52] U.S. Cl. ..... 405/262; 405/284; 405/286

[58] Field of Search ..... 405/262, 284, 405/285, 286

[56] References Cited

U.S. PATENT DOCUMENTS

| | | | |
|---|---|---|---|
| 4,834,584 | 5/1989 | Hilfiker | 405/262 |
| 5,451,120 | 9/1995 | Martinez-Gonzales | 405/262 |
| 5,533,839 | 7/1996 | Shimada | 405/284 |

FOREIGN PATENT DOCUMENTS

| | | | |
|---|---|---|---|
| 176525 | 7/1988 | Japan | 405/262 |
| 268815 | 11/1988 | Japan | 405/262 |

*Primary Examiner*—Eileen Dunn Lillis
*Assistant Examiner*—Frederick L. Lagman
*Attorney, Agent, or Firm*—Limbach & Limbach, L.L.P.

[57] ABSTRACT

Adjustable connections are provided to enable facing to be secured to anchor elements embedded in an earthen formation, without requiring precise alignment of the anchor elements with connectors on the facing. In one embodiment specially configured bars engage and span the connectors on the facing for rotation relative to the connectors and slotted plates are carried by the bars for connection to the anchor elements. In another embodiment a channel structure is secured to and extends across the facing and a plate assembly having a slot therein for receipt of the anchor elements is slidably received within the channel structure. The anchor elements may comprise bolts secured to a cross-member extending behind soil reinforcing mats embedded within the earthen formation being retained.

20 Claims, 8 Drawing Sheets

SYSTEM FOR SECURING A FACE PANEL TO AN EARTHEN FORMATION

FIELD OF THE INVENTION

The present invention relates to a new and improved structure for attaching concrete face panels to earthen formations. In its more particular aspects, the invention is concerned with such a structure for attaching face panels to anchor bolts which extend from soil reinforcements, deadman anchors or drilled vertical shafts. The invention is especially concerned with such a structure which enables a retained earthen formation to be constructed and permitted to settle prior to the attachment of face panel elements and which does not require precise alignment of the anchor bolts with connectors on the face panel elements.

BACKGROUND OF THE INVENTION

The customary way of erecting a retaining wall and securing face panels to the wall is to successively place the panels at the face of the earthen formation and backfill behind the panels as the wall is erected. An erection technique of this type may be seen in U.S. Pat. No. 4,929,125 by William K. Hilfiker, one of the co-inventors herein. With this type of construction, connection of the face panels to the soil reinforcing elements takes place before the elements are embedded and, as a result, precise alignment of the soil reinforcing elements with connectors on the panels is possible. The disadvantage of this technique, however, is that substantial settling of the earthen formation can occur after the connections between the soil retaining elements and the face panels have been made. This can result in significant strain on the connections.

The prior art also teaches flexible or slidable connections between face panels and anchors elements embedded within a formation to permit settling of the formation without straining the connection between the panels and the embedded elements. One such technique is found in U.S. Pat. No. 4,343,572 to William K. Hilfiker wherein the deformable sections are incorporated into the anchor elements adjacent the face member to permit the anchor elements to controllably deform, while maintaining the face member in place. Other techniques are found in U.S. Pat. No. 1,762,343 to Munster, U.S. Pat. No. 4,407,611 to Murray et al. and U.K. patent application 2,014,222 to Brown et al. The latter patents and application provide means to enable embedded anchors to slide vertically relative to face panels to accommodate settlement of the earthen formation behind the panels.

SUMMARY OF THE INVENTION

The attachment of the present invention is ideally suited for earthen formations that are constructed on compressible foundations. With such formations, typically 90 percent of the total foundation settlement occurs during construction. The invention is designed to provide a connection for face panels which enables the retaining wall system to be constructed and allowed to settle before the facing elements are attached. The advantage of this system over present concrete panel reinforced soil systems is that the foundation can settle prior to placement of the facing, with the result that stress at the connection between the anchor elements and the facing panels is materially reduced.

The improved connecting structure of the present invention is designed for securing a face panel to an earthen formation after the formation has been retained and permitted to settle. It comprises a tension resisting element such as a bolt embedded within the formation and extending from its face and movable connection structure secured to the face panel to provide for adjustable connection of the panel to the bolt.

In the preferred embodiment, the invention utilizes precast segmental concrete panels with protruding connectors that are cast directly into the panels. A threaded anchor is embedded in and anchored into the earthen formation, as for example by soil reinforcements, deadman anchors or drilled shafts. The connectors on the panel and the threaded anchors are tied together using a specially shaped tie bar, anchor bolt and anchor plate. This unique combination ties the panel to the earthen formation without requiring precise alignment of each element during the casting of the panel and erection of the retaining structure for the earthen formation.

The connection of the invention allows for horizontal and vertical relative translatory movement from one location to another between the tension resisting anchor elements embedded in the formation and the face panel. The connection also provides for adjustment of the panel toward and away from the formation to tension the connection and plumb or incline the face panel as desired.

A principal object of the present invention is to provide a structure for attaching face panels to a retained earthen formation after the formation has been permitted to settle, without the need for having precise alignment between the anchor elements within the formation and connections cast in place within the face panel.

Another object of the invention is to provide a connection whereby face panels may be secured to various types of retaining structures after the soil around the structures has been compacted and permitted to settle.

Another object of the invention to provide a connection for a soil reinforced retaining wall utilizing angle-shaped welded wire or geogrid mats with a cross member disposed behind the mats to carry the anchor element to which connection is made.

Another object related to the latter object is to provide such a soil reinforced wall where the connection may be made to a cast in place facing, or to provide reinforcement in the cavity between the back face of the panel secured in place by the connection and the face of the earthen formation.

Still another object related to the soil reinforced embodiment of the invention is to provide a connection which ties the soil reinforcement to the panel connection.

The foregoing and other objects will become more apparent when viewed in light of the following detailed description and accompanying drawings.

DESCRIPTION OF THE PREFERRED EMBODIMENTS

First Embodiment

Figure 1:
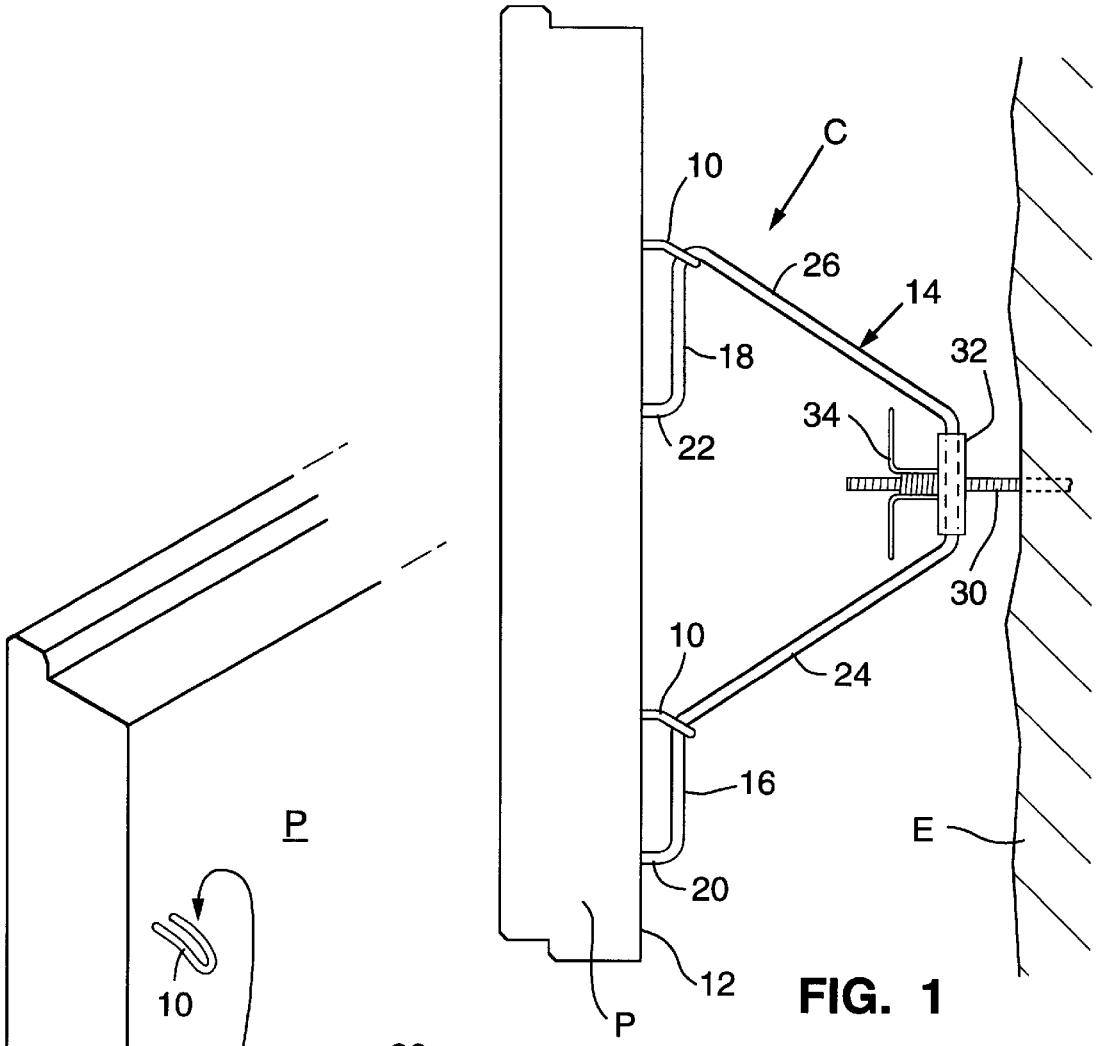
FIG. 1 is an elevational view of a first embodiment of the inventive connector shown securing a face panel to the face of an earthen formation.
Figure 2:
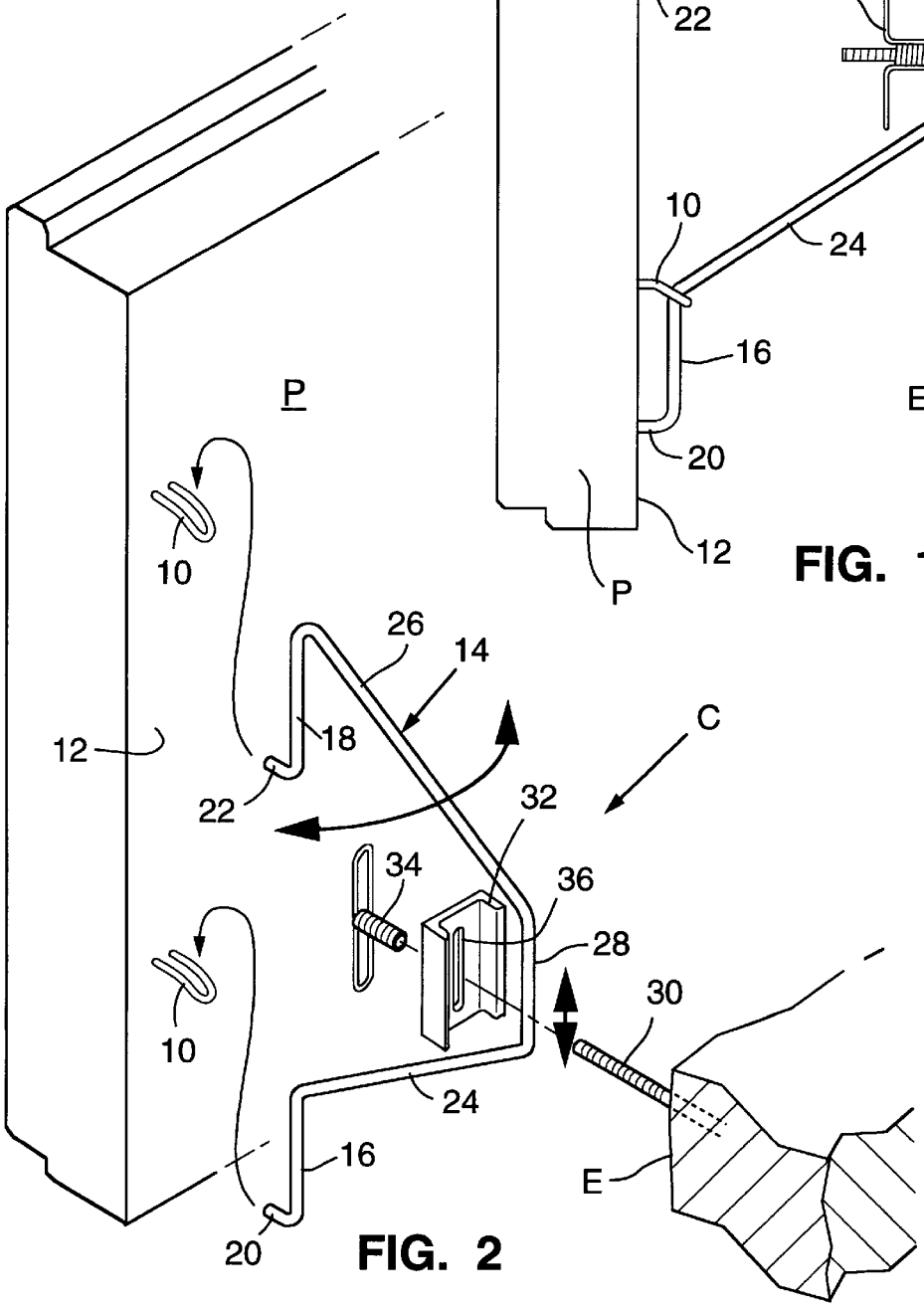
FIG. 2 is an exploded perspective view of the connector of FIG. 1.

FIGS. 1 and 2

Referring now to FIG. 1, a face panel P is shown therein secured to the face of an earthen formation E by the inventive connector of the present invention, designated in its entirety by the letter C. The face panel P is formed of precast reinforced concrete and has U-shaped steel loops 10 embedded therein and extending from its rearward surface 12. The loops are arranged in generally vertically aligned pairs, as may be seen in FIG. 2. The manner in which the loops are anchored within the panel may correspond to that of U.S. Pat. No. 4,993,879.

A butterfly wing-shaped connection bar 14 fabricated of one half inch steel stock is engaged with and extends rearwardly from the panel P. The bar comprises: aligned leg portions 16 and 18 extensible through the loops 10 (As may be seen from the arrow lines in FIG. 2, the leg portions 16, 18 are slid into engagement with the loops 10 from one side. Once so positioned, the bar is hinged to the panel P about an axis extending through the loops.); foot portions 20 and 22 extending from the leg portions 16 and 18, respectively; inclined portions 24 and 26 extending from the leg portions 16 and 18, respectively; and a spanning portion 28 extending between the inclined portions. The foot portions 20 and 22 are proportioned to engage the rearward surface 12 of the face panel when the connection bar is received within the loops, as seen in FIG. 1. In a typical embodiment, the horizontal dimension between the tips of the foot portions 20 and 22 and the spanning portion 28 is 14 inches. Typical vertical dimensions for the bar 14 are: 5 inches for the leg portion 16, 6 inches for the leg portion 18, 10 inches for the inclined portion 24, 8⅛ inches for the inclined portion 26, and 5½ inches for the spanning portion 28.

A threaded tension resisting element in the form of an anchor bolt 30 protrudes from the face of the earthen formation E. The purpose of this bolt is to enable the face panel P to be secured to the earthen formation. It may be embedded and anchored in the formation in any number of ways, e.g. by being secured to and extending from a soil reinforcing mat, by being secured to a deadman anchor, or by being secured to a drilled shaft. The bolt 30 is secured to the connection bar 14 by moment resisting element in the form of a channel 32 received around the spanning portion 28 and a tension resisting collar in the form of a nut 34 threadably engaged with the bolt. The bolt 30 extends through a slot 36 formed in the bight portion of the channel. Typical dimensions for the channel are 3⁄16 inch thickness, 5 inches in length and 2 inches in width. With these dimensions, the slot 36 may have a width of slightly over ½ inch to slidably accommodate a ½ inch bolt 30 and a length of 3 inches. The nut 34 may be of a ½ inch coil wing nut construction.

With the foregoing construction, face panels P may be readily secured to the face of an earthen formation without the need for precise alignment between the anchor bolts 30 and connection loops 10 of the panels. This results because the connections provide a significant degree of both lateral and vertical translatory movement of the connections from one location to another relative to the panels. Lateral movement is provided by hinging of the leg portions 16 and 18 within the loops 10 and is depicted by the arcuate arrow line in FIG. 2. Vertical movement is provided by movement of the bolt 30 within the elongate slot 36 and may also be accommodated by fabricating the channel 32 of a height dimension less than that of the spanning portion 28 in order that the channel may be adjusted vertically relative to the spanning portion.

In making the connection between the bolt 30 and the panel P, the bolt is extended through the slot 36 to one side of the spanning portion 28 and the nut 34 is then threadably engaged with the end of the bolt to pull the channel against the spanning portion. The nut may be adjusted along the length of the bolt to tension the bolt and position the bolt relative to the plate. Through the latter mechanism, the panels P may be plumbed or inclined, as desired.

Second Embodiment

Figure 4:
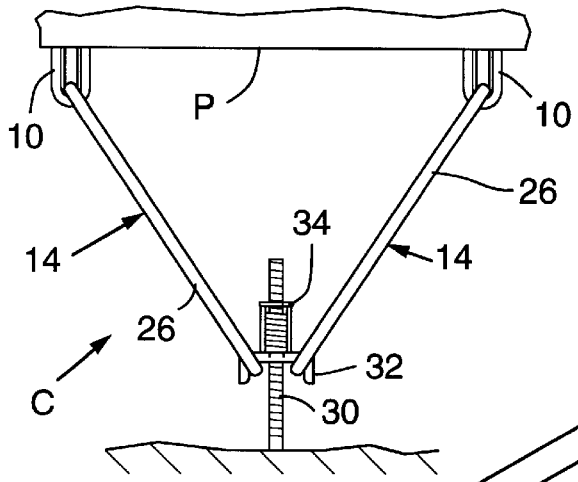
FIG. 4 is a plan view of the second embodiment connector of FIG. 3, illustrating the connector securing a face panel to the face of an earthen formation.
Figure 3:
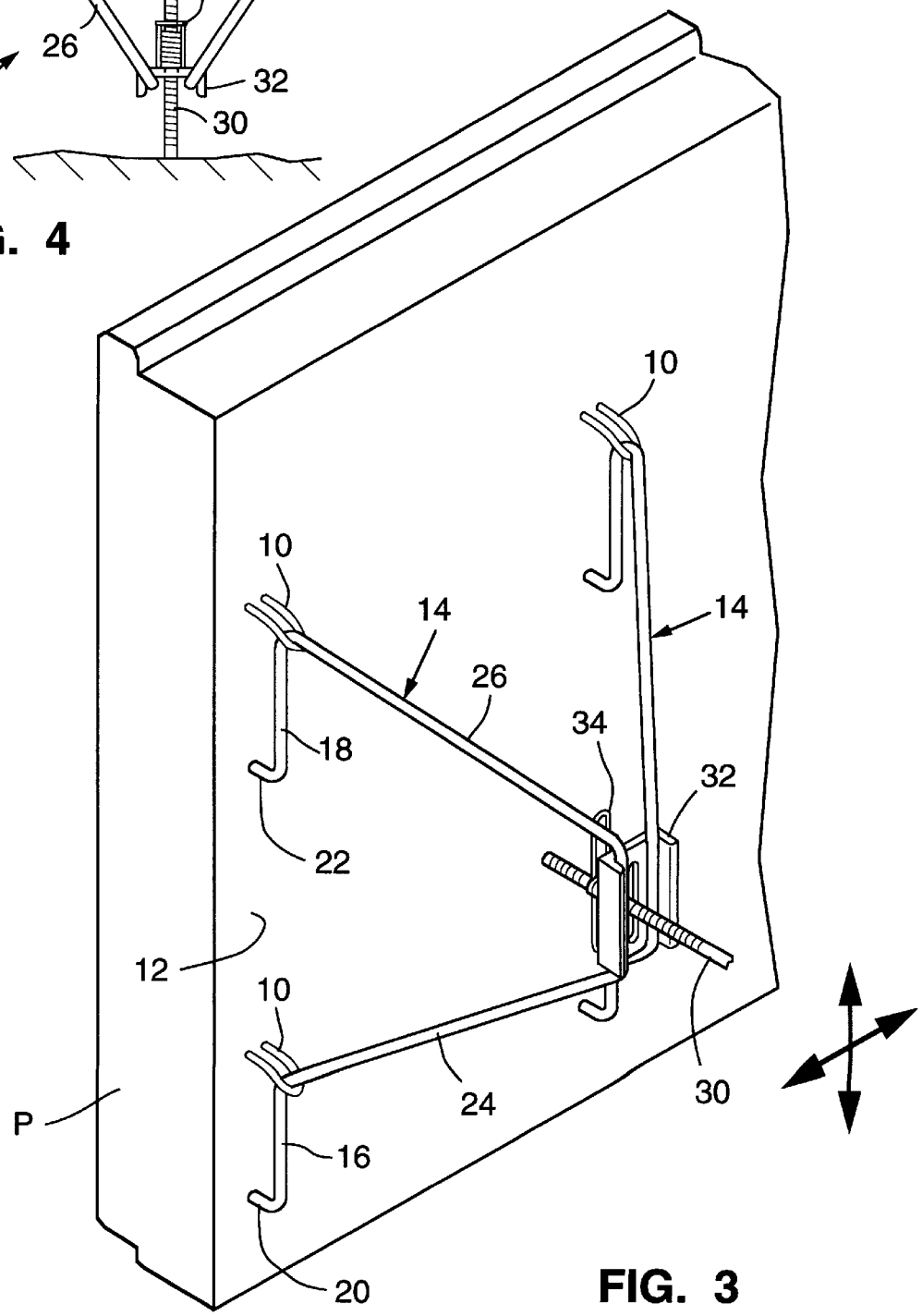
FIG. 3 is a perspective view of a second embodiment of the inventive connector, shown secured to a face panel.

FIGS. 3 and 4

This embodiment corresponds to the first embodiment, except that it uses a pair of connection bars 14 and associated loops 10. Accordingly, components of the second embodiment are the same as those of the first embodiment and designated by corresponding numbers.

The use of a pair of connection bars 14 results in a triangulated structure, as may be seen from FIGS. 3 and 4. The structure is assembled in the same manner as that of the first embodiment, with the addition that a second connector bar 14 is provided and the moment resisting channel 32 extends around the spanning portions 28 of both of the bars, with the bolt 30 extending between the spanning portions. The resulting structure accommodates both vertical and lateral translatory movement of the bolt 30 from one location to another relative to the panel P, as depicted by the arrow lines. Lateral movement is more limited than that of the first embodiment, however, because of the triangulated structure provided by the paired connection bars 14.

Figure 10:
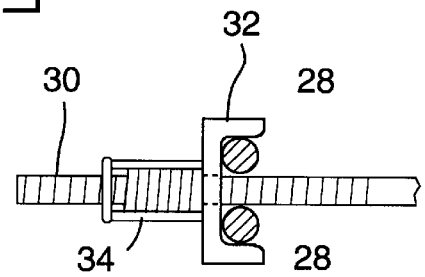
FIG. 10 is an enlarged plan view of the channel portion of the connector used in the first through fifth embodiments of the invention, as it would appear with two retaining rods received within the channel and a bolt extending through the bight portion of the channel.
Figure 11:
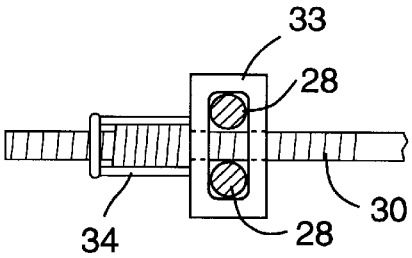
FIG. 11 is an enlarged plan view of a box section which may be used in place of the channel of FIG. 9, as it would appear with two retaining rods received within the box section and a bolt extending through the box section between the rods.
Figure 12:
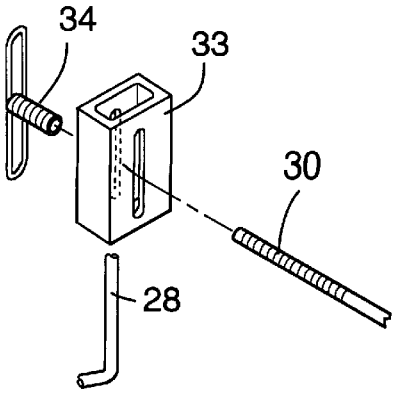
FIG. 12 is a perspective view of the box section of FIG. 11, with the bolt, nut and retaining rod which would be used with the section shown in exploded perspective.

The interrelationship between the channel 32, the spanning portions 28 and the bolt 30 may be seen in greater detail from FIG. 10. FIGS. 11 and 12 illustrate a box section 33 which may be used in place of the channel 32. This has slots 35 extending through opposed walls thereof for receipt of the bolt 30. The operation of the box section 33 corresponds to that of the channel 32, with the addition that the spanning portions 28 are fully captured within the box section.

Third Embodiment

Figure 5:
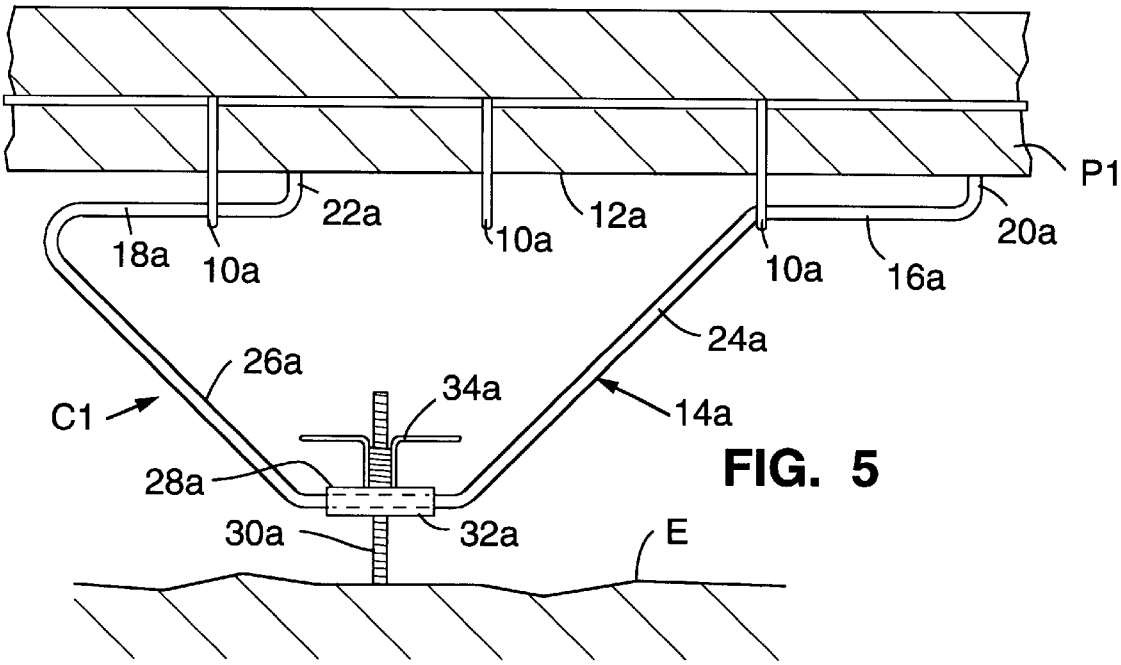
FIG. 5 is a plan view of a third embodiment of the inventive connector shown securing a face panel to the face of an earthen formation.
Figure 6:
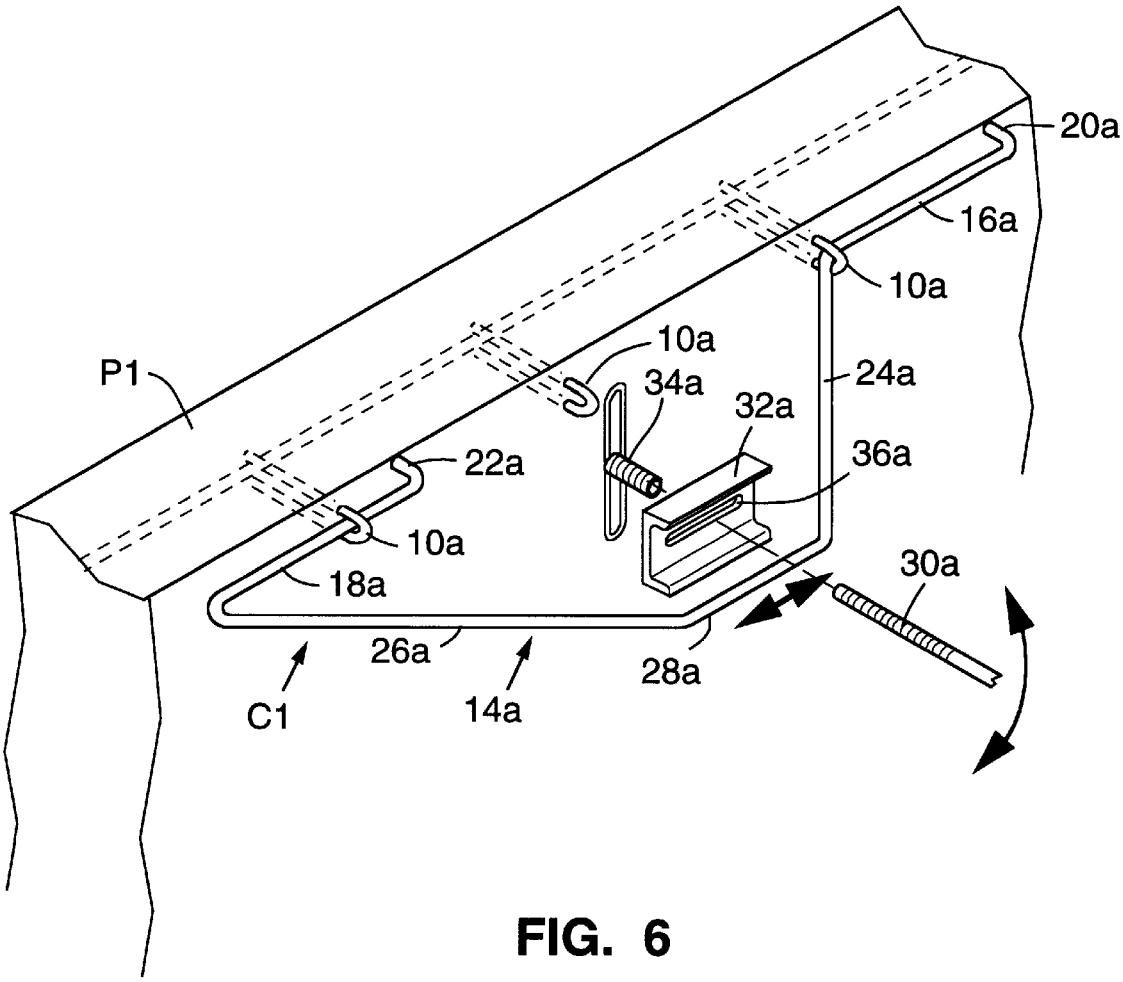
FIG. 6 is a partially exploded perspective view of the third embodiment connector of FIG. 5, shown secured to a face panel.

FIGS. 5 and 6

The third embodiment corresponds generally to that of the first embodiment, with the exception that the connection bar, designated 14*a* extends horizontally and is received within horizontally spaced loops 10*a*. The face panel of the third embodiment is designated P1 and the connector is designated C1. The rearward surface of the panel P1 is designated 12*a*. Components of the connector C1 corresponding to those of the first embodiment connector are designated by like numerals, followed by the letter "a" as follows: Connection bar 14*a*, leg portions 16*a* and 18*a*; foot portions 20*a* and 22*a*; inclined portions 24*a* and 26*a*; spanning portion 28*a*; anchor bolt 30*a*; channel 32*a*; nut 34*a*; and slot 36*a*.

The third embodiment connector is assembled and adjusted in the same way as that of the first embodiment, the only difference being that the assembled connector provides for relative horizontal translatory movement between the bolt 30*a* and the panel P1 by translatory movement of the bolt within the slot 36*a* and for relative vertical movement by hinging of the connector C1 within the loops 10*a*.

Fourth Embodiment

Figure 7:
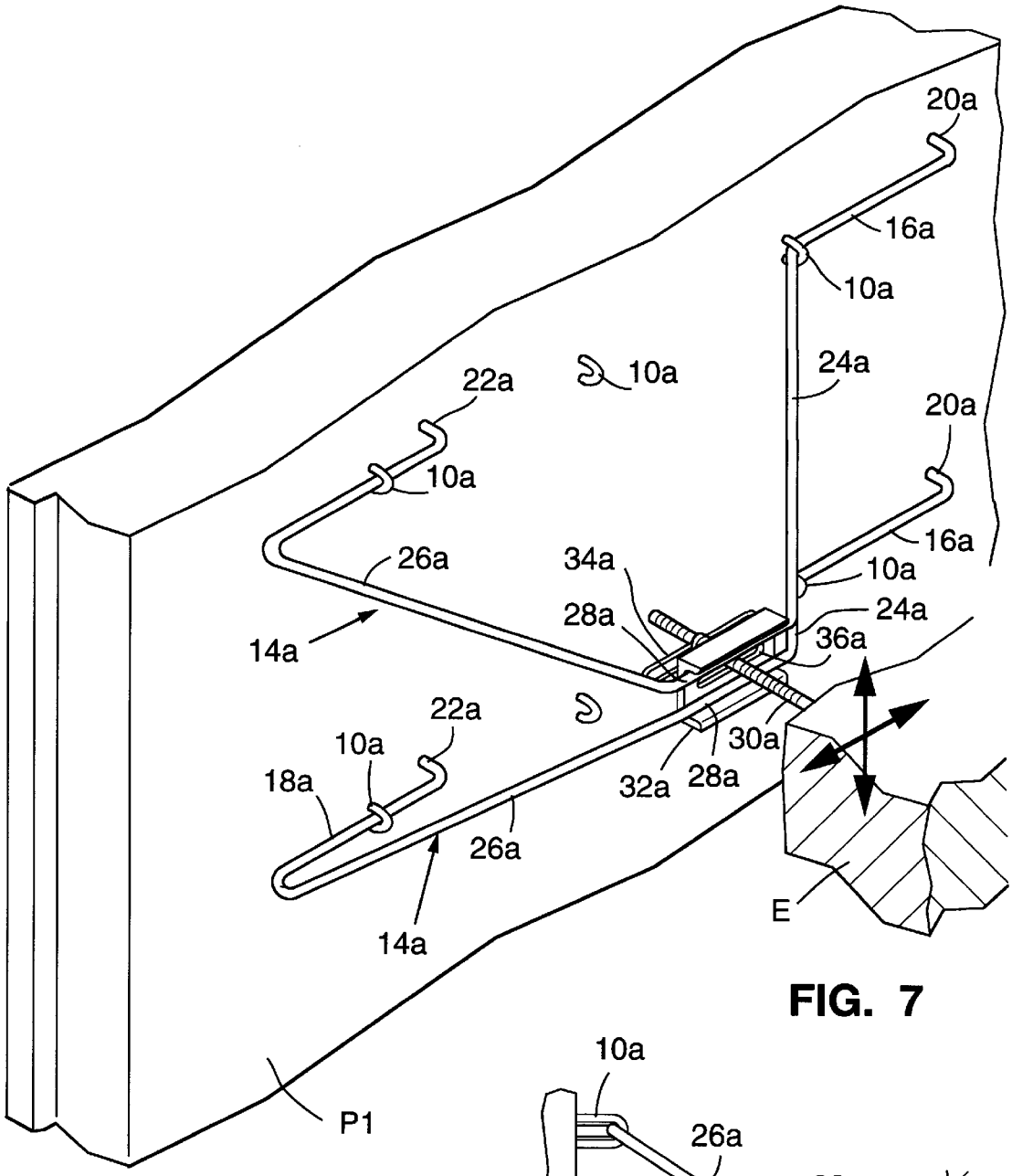
FIG. 7 is a perspective view of a fourth embodiment of the inventive connector, shown secured to a face panel.
Figure 8:
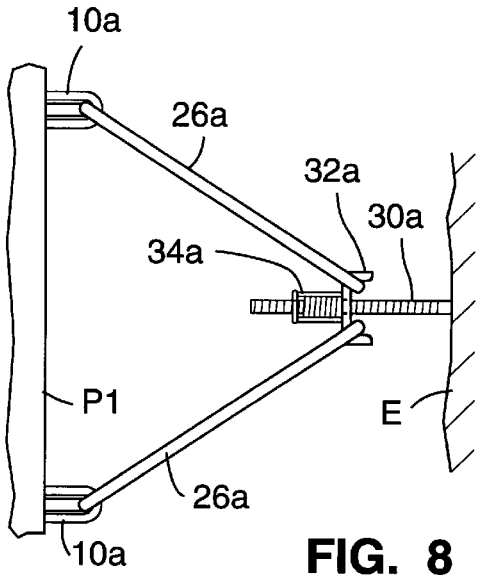
FIG. 8 is an elevational view of the fourth embodiment connector of FIG. 7 illustrating the connector secured between a face panel and an earthen formation.

FIGS. 7 and 8

The fourth embodiment corresponds to the third embodiment, with the addition of a second connector bar 14*a*. Components of the fourth embodiment connector are designed by the same numerals used for the third embodiment connector.

The fourth embodiment connector is assembled with the connection bars 14*a* in generally triangulated relationship with the spanning portions 26*a* received in the channel 32*a* to either side of the anchor bolt 30*a*. The resulting structure provides for horizontal adjustment of the panel relative to the earthen formation by sliding of the bolt within the slot 36*a* and for vertical adjustment of the panel P1 relative to the earthen formation E by up and down hinging of the connection bars within the loops 10*a*. Such hinging is more limited than that of the third embodiment as the result of the triangulated configuration that the connection bars 14*a* assume relative to one another.

Fifth Embodiment

Figure 9:
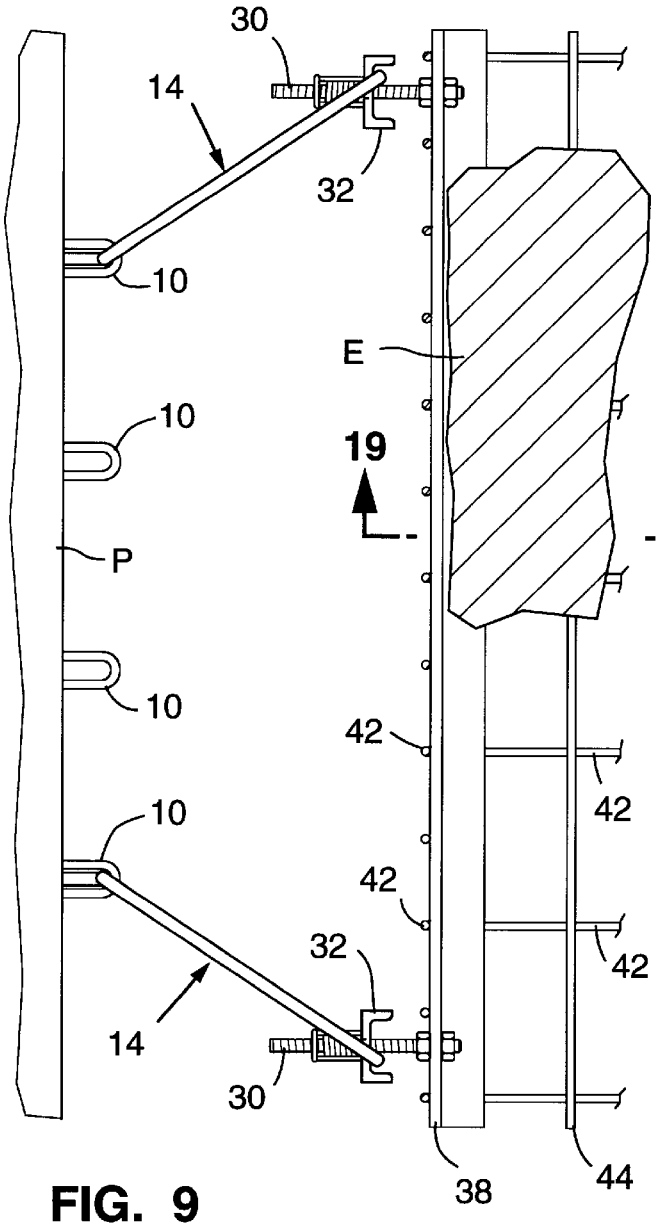
FIG. 9 is a plan view of a fifth embodiment of the inventive connector, shown securing a face panel to the face of an earthen formation reinforced by a soil reinforcing mat.
Figure 19:
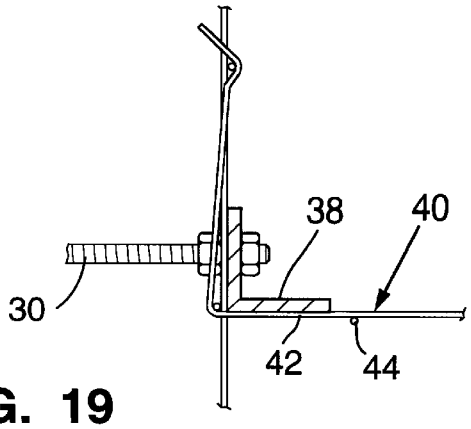
FIG. 19 is a cross-sectional view taken on the plane designated by line 19—19 of FIG. 9.

FIGS. 9 and 19

The fifth embodiment connector utilizes two of the first embodiment connectors inclined outwardly relative to the panel P toward horizontally spaced tension resisting anchor bolts 30 extending from the earthen formation E. The resulting connection has a trapezoidal configuration when viewed in plan, as seen in FIG. 9. Relative vertical translatory movement between the panel P and the earthen formation E is provided by the slots within the channels 32. Relative horizontal translatory movement is provided by hinging action between the connection bars 14 and the loops 10. The nuts 34 may be adjusted on the bolts 30 to maintain parallelism of the panel P with the face of the earthen formation E if hinging significantly alters the symmetry of the trapezoidal connection.

The anchor bolts 30 of the fifth embodiment are carried by a moment resisting element in the form of an angle plate 38 engaged behind the face of a welded wire soil reinforcing mat 40. The illustrated mat comprises longitudinal wires 42 extending into the formation and partially over its face. Cross wires 44 are welded to the longitudinal wires 42. The overall construction of the welded wire mat and the face elements used with the mat may be seen from copending application Ser. No. 08/652,321, filed May 23, 1996, now U.S. Pat. 5,722,799 by William K. Hilfiker, on e of the coinventors herein.

In the fifth embodiment, the tension resisting anchor bolts are held against pull out from the formation by their connection to the angles 38, which in turn are held by the face elements of the welded wire mats. The cavity between the back face of the panel P and the front of the welded wire mat may have a cast in place fill. A rebar mat may be disposed in this fill to further reinforce the cast in place structure.

Sixth Embodiment

FIGS. 13–15

The connector of this embodiment comprises a pair of opposed angle members 46 defining a channel therebetween which slidably receives an upright follower channel member 48. Clips 50 are welded to the angle members 46 and secured to J-bolts 52 embedded in a concrete face panel, designated P2. A slotted moment resisting plate 54 has hoops 56 welded thereto and extending slidably around the channel member 48. The slot in the plate 54 is designated 58 and designed for receipt of an anchor bolt 30 extending from the earthen formation E. Tension resisting collars in the form of nuts 60 are threadably engaged with the bolt 30 to either side of the plate 54 to secure the bolt to the plate.

Figure 13:
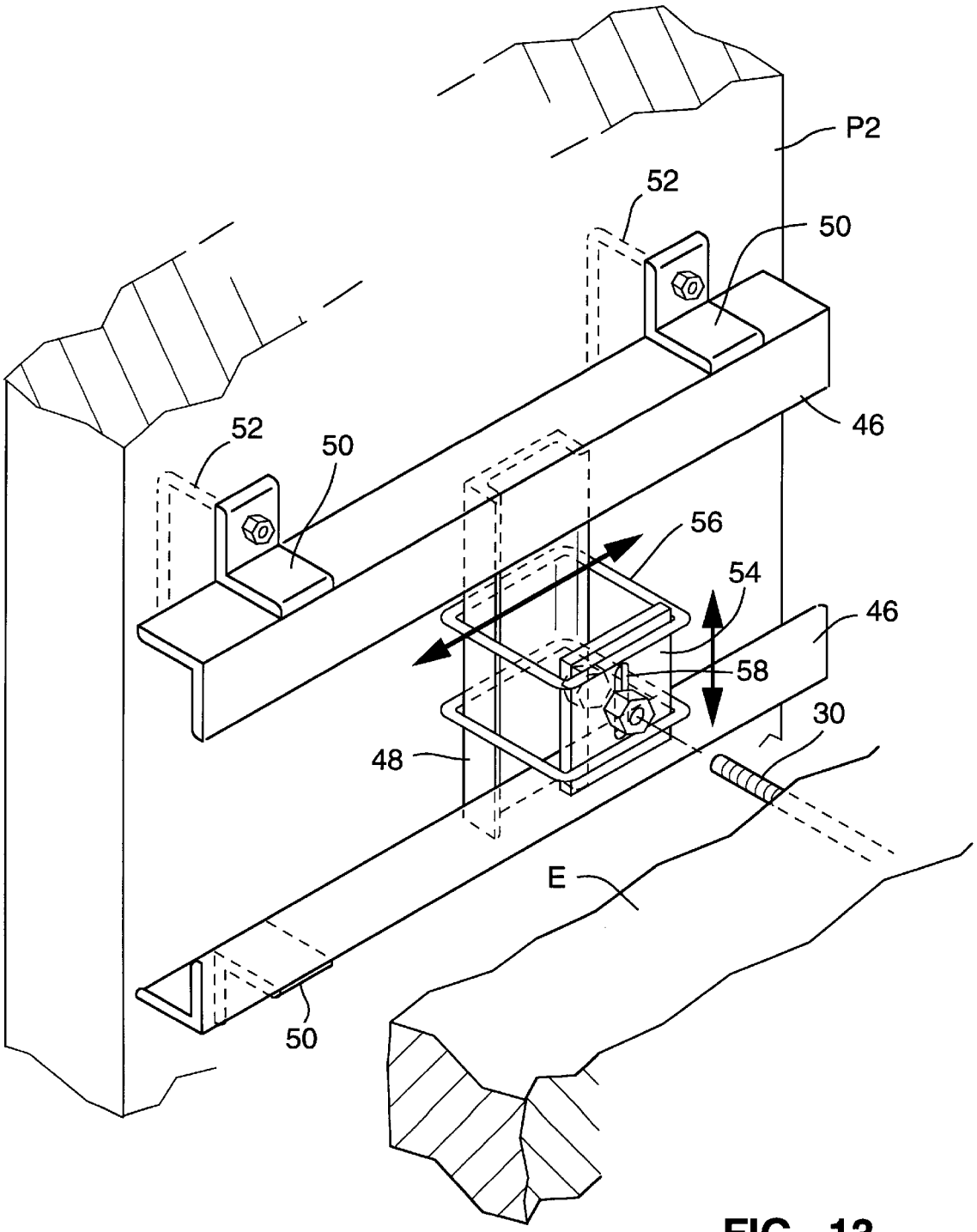
FIG. 13 is a perspective view of a sixth embodiment of the inventive connector, shown securing a face panel to an earthen formation.
Figure 14:
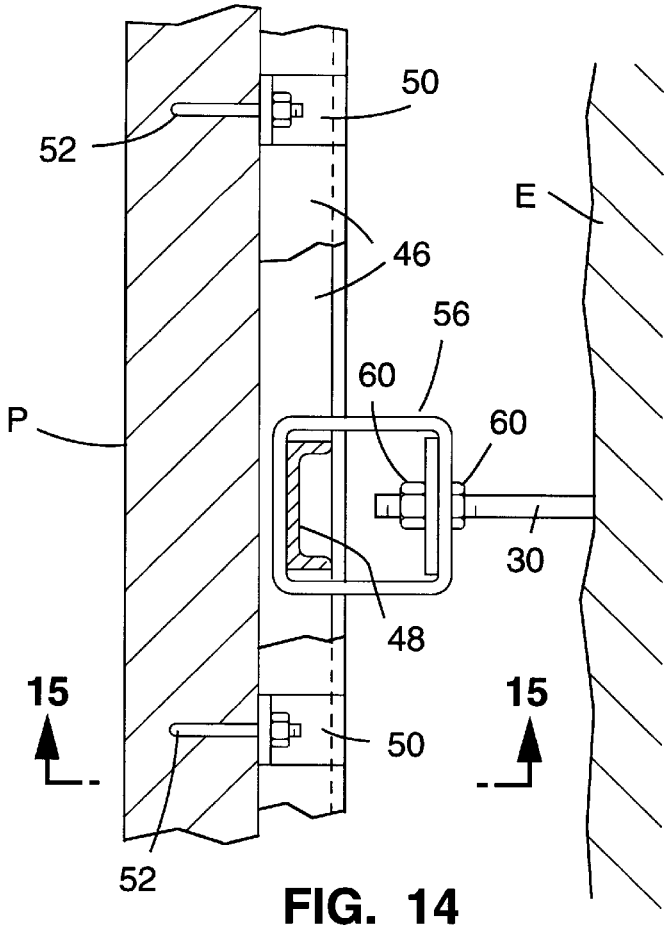
FIG. 14 is a plan view of the sixth embodiment connector of FIG. 13, with parts thereof broken away and shown in section.
Figure 15:
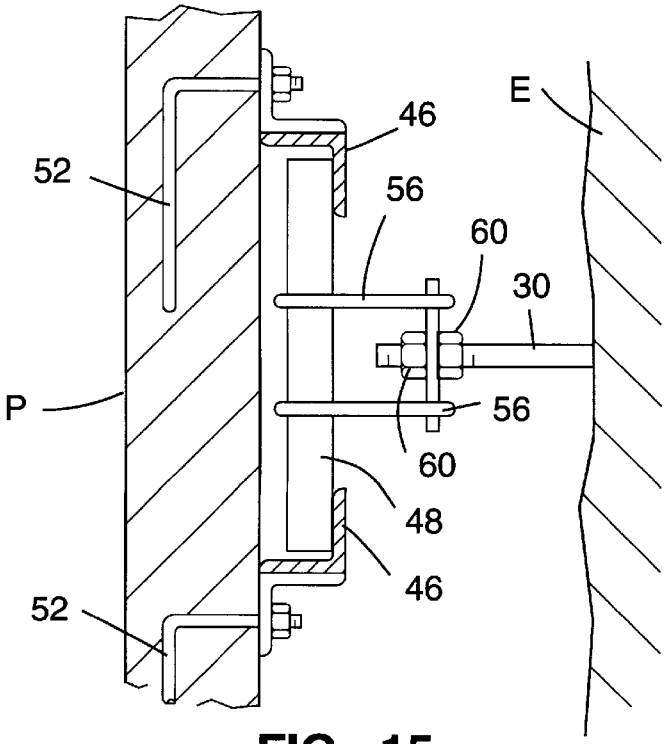
FIG. 15 is a cross-sectional elevational view taken on the plane designated by line 15—15 of FIG. 14.
Figure 17:
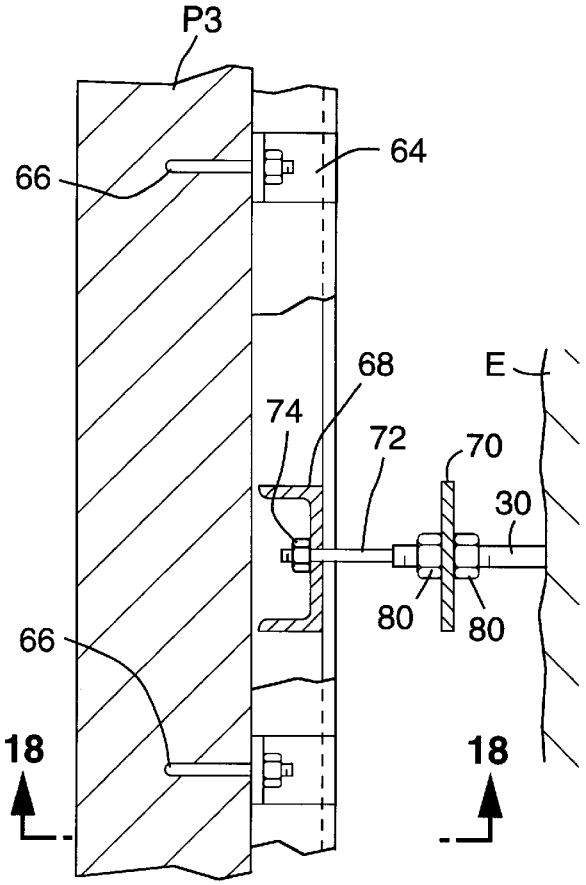
FIG. 17 is a plan view of the seventh embodiment connector shown in FIG. 16, with parts thereof broken away and shown in section.
Figure 16:
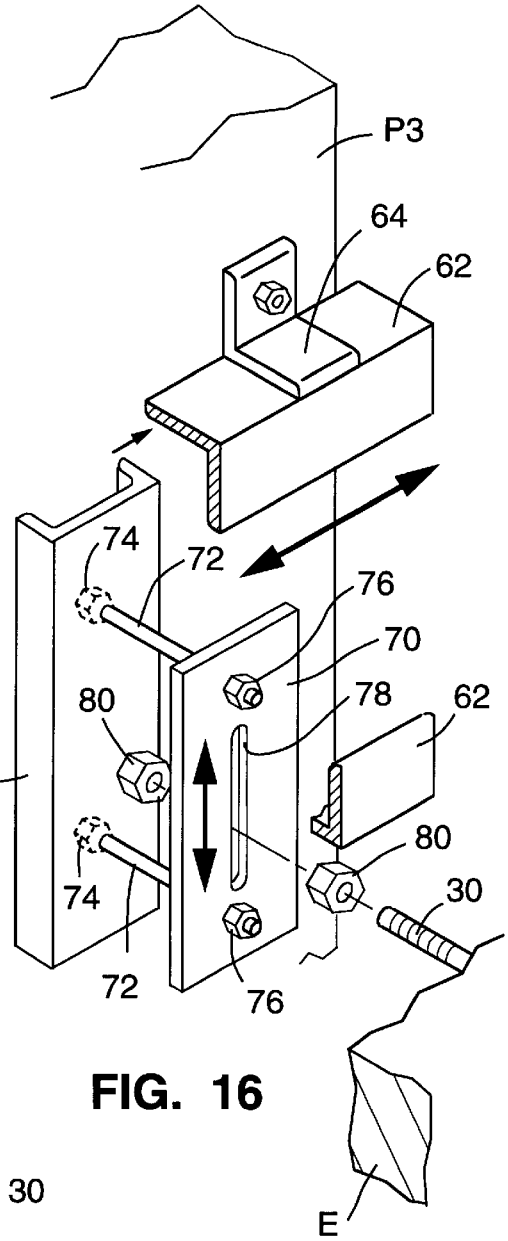
FIG. 16 is an exploded perspective view of a seventh embodiment of the inventive connector, shown securing a face panel to the face of an earthen formation.
Figure 18:
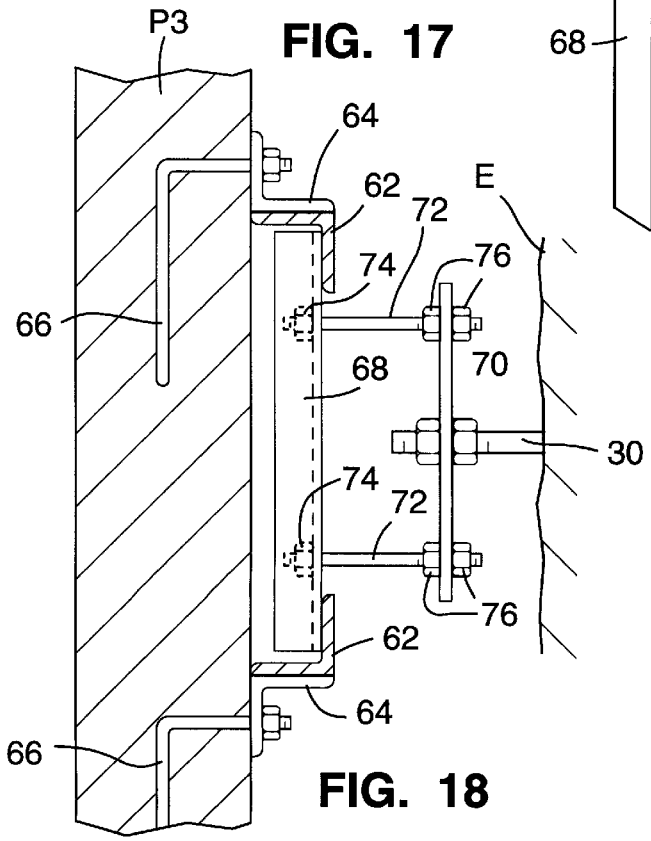
FIG. 18 is a cross-sectional elevational view of the seventh embodiment connector taken on the plane designated by line 18—18 of FIG. 17.

Relative horizontal translatory movement of the panel P2 from one location to another relative to the earthen formation E is provided by sliding of the follower channel 48 within the angle members 46, as depicted by the horizontal arrow line in FIG. 13. Vertical translatory movement of the panel P2 from one location to another relative to the earthen formation E is provided by sliding of the hoops 56 over the channel member 48, as depicted by the vertical arrow line in FIG. 13. Additional vertical movement may be provided by adjusting the vertical position of the bolt 30 within the slot 58.

Seventh Embodiment

FIGS. 16–18

The connection of this embodiment comprises: opposed angle members 62 defining a channel therebetween; clips 64 welded to the angle members 62 and secured to J-bolts 66 embedded within a face panel P3; a vertically extending follower channel member 68 slidably received between the angle members 62; a moment resisting element in the form of a slotted plate 70 secured in fixed spaced parallel relationship to the channel member 68 by spacer bolts 72 threadably engaged with nuts 74 mounted on the channel member 68 and nuts 76 disposed to either side of the plate 70; a vertically extending slot 78 formed through the plate 70 for slidable receipt of the anchor bolt 30; and, tension resisting collars in the form of nuts 80 threadably received on the anchor bolt 30 to either side of the plate 70 to hold the bolt 30 within the slot 78.

The seventh embodiment connection provides for horizontal translatory movement of the panel P3 relative to the earthen formation E by sliding of the follower channel member 68 within the angle members 62, as depicted by the horizontal arrow line in FIG. 19. Vertical translatory movement of the panel relative to the earthen formation is provided by sliding the bolt 30 within the slot 78. The nuts 80 may be used both to adjust the tension on the bolt 30 and to lock the bolt relative to the plate 70.

CONCLUSION

From the foregoing detailed description it is believed apparent that the present invention provides an improved mechanism for securing face panels to an earthen formation which is formed and compacted prior to attachment of the panels. In particular, the invention provides such a connection which does not require precise alignment between the anchor bars extending from the earthen formation and fixed connection points on the face panels. It should be understood, however, that the invention is not intended to be limited to the specifics of the illustrated embodiments, but rather is defined by the accompanying claims.

What is claimed is:

1. In combination with an earthen formation having an anchor bolt extending therefrom for attachment to a face for the formation, an improved structure for connecting the bolt to the face whereby multi-directional adjustment of the connection between the bolt and face is provided, said structure comprising:

a) anchor loops secured to and extending rearwardly from the face at spaced locations relative to one another;

b) a first connecting rod having end portions rotatably engaged within the loops and a bowed intermediate portion extending outwardly and rearwardly relative to the face for swinging movement relative to the face in a first given path as the end portions of the rod rotate within the loops engaged therewith;

c) a plate carried by the intermediate portion of the first connecting rod, said plate having an aperture therein through which the bolt extends, said aperture being elongate to enable the bolt to slide transversely relative to said first given path; and, d) an element securing the bolt against removal from the aperture.

2. In a combination according to claim 1, the improved structure wherein the element securing the bolt against removal from the aperture is adjustable along the bolt to adjust the tension on the bolt and the position of the bolt relative to the plate.

3. In a combination according to claim 2, the improved structure wherein the element securing the bolt against removal from the aperture is a nut threadably received on the bolt.

4. In combination with an earthen wall having an anchor bolt extending therefrom for attachment to a face for the wall, an improved structure for connecting the bolt to the face, comprising:

a) anchor loops secured to and extending rearwardly from the face at spaced locations relative to one another;

b) a first connecting rod having end portions engaged within the loops and an intermediate portion extending outwardly and rearwardly relative to the face;

c) a plate carried by the intermediate portion of the first connecting rod, said plate having an aperture therein through which the bolt extends;

d) an element securing the bolt against removal from the aperture; and, e) a second connecting rod having end portions engaged within loops extending rearwardly from the face in spaced relationship to the loops engaged by the first connecting rod and an intermediate portion extending outwardly and rearwardly relative to the face; wherein the plate is also carried by the intermediate portion of the second connecting rod.

5. In a combination according to claim 4, the improved structure wherein the plate is of a U-shaped cross-section and has a bight portion extending across the intermediate portions of the first and second rods and leg portions extending, respectively, outside the intermediate portions of the first and second rods to hold said rods against separation.

6. In a combination according to claim 5, the improved structure wherein the aperture extends through the bight portion between the intermediate portions of the first and second rods.

7. In a combination according to claim 4, the improved structure wherein the plate is of a box-shaped cross-section defining a passage extending therethrough and the intermediate portions of the first and second rods extend through the passage.

8. In a combination according to claim 7, the improved structure wherein the aperture extends through the plate between the intermediate portions of the first and second rods.

9. In a combination according to claim 1 wherein the earthen formation has a second anchor bolt for attachment to the face, the improved structure further comprising:

a) a second connecting rod having end portions rotatable engaged within loops extending rearwardly from the face in spaced relationship to the loops engaged by the first connecting rod and a bowed intermediate portion extending outwardly and rearwardly relative to the face for swinging movement relative to the face in a second given path as the end portions of the second rod rotate within the loops engaged therewith;

b) a plate carried by the intermediate portion of the second connecting rod, said plate having an aperture therein through which the second bolt extends which is elongate to enable the second bolt to slide transversely relative to said second given path; and, c) an element securing the second bolt against removal from the aperture of the plate carried by the intermediate portion of the second connecting rod.

10. In combination with an earthen wall having an anchor bolt extending therefrom for attachment to a face for the wall, an improved structure for connecting the bolt to the face, comprising:

a) anchor loops secured to and extending rearwardly from the face at spaced locations relative to one another;

b) a first connecting rod having end portions engaged within the loops and an intermediate portion extending outwardly and rearwardly relative to the face;

c) a plate carried by the intermediate portion of the first connecting rod, said plate having an aperture therein through which the bolt extends;

d) an element securing the bolt against removal from the aperture; and, e) feet on the end portions of the rod for engagement with the face in opposition to pulling forces applied to the intermediate portion of the rod in a rearward direction relative to the face.

11. An improved connection for securing a face panel to an earthen formation for multi-directional adjustment to accommodate different relative positions of the face panel and earthen formation, said connection comprising:

a) a tension resisting element embedded within the earthen formation and extending therefrom;

b) first connector secured to the face panel for translatory movement from one location to another relative to the panel in a path extending across the panel in a first direction;

c) a second connector secured to the first connector for movement therewith; and, d) means securing the tension resisting element to the second connector for translatory movement from one location to another relative to the panel in a second path extending across the face panel in a direction generally normal to the first path, said means also securing the tension resisting element to the panel for adjustment in a third path extending generally normal to said second path.

12. An improved connection according to claim 11 wherein a) said second connector comprises a moment resisting element secured to the first connector in generally parallel relationship to the face panel:

b) the means securing the tension resisting element to the second connector comprises:

1) an opening defined by the moment resisting element which extends in generally the same direction as the second path, said opening being proportioned for tension resisting element; and, 2) a tension resisting collar received on the tension resisting element to secure removal of the tension resisting element from the second connector.

13. The improved connection according to claim 12 wherein the collar is capable of movement and attachment along the tension resisting element in order to transfer tension from the tension resisting element into the second connector.

14. An improved connection according to claim 11 wherein:

a) the earthen formation is retained by soil reinforcing structure having a first portion extending into the formation and a second portion extending over the face of the formation;

b) the tension resisting element protrudes from the second portion and is secured to the formation by engagement with a moment resisting element positioned between the second portion and the face of the formation.

15. An improved connection according to claim 11 wherein the first connector comprises:

a) anchor loops secured to and extending rearwardly from the face panel at spaced locations relative to one another; and, b) a first connecting rod having end portions engaged within the loops and an intermediate portion extending outwardly and rearwardly relative to the face panel for rotation about an axis defined by the loops.

16. An improved connection according to claim 15, further comprising feet on the end portions of the rod for engagement with the face panel in opposition to pulling forces applied to the intermediate portion of the rod in a rearward direction relative to the face panel.

17. An improved connection for securing a face panel to the face of an earthen formation, said connection comprising:

a) a bolt embedded within the formation and extending from the face thereof;

b) a first connector secured to the face panel for movement in a path extending across the panel in a first direction, said first connector comprising;

1) a channel structure secured to and extending across the face panel; and, 2) a follower received within the channel structure for slidable movement therein across the face panel;

c) a second connector secured to the first connector for movement therewith; and, d) means securing the bolt to the second connector for movement relative thereto in a second path, said second path extending across the face panel in a direction generally normal to the first path.

18. An improved connection according to claim 17 wherein said second connector comprises a plate secured to the follower in generally parallel relationship to the face panel.

19. An improved connection according to claim 18 wherein the plate is secured to the follower for movement relative thereto in the second path.

20. An improved connection according to claim 18 wherein the means securing the bolt to the second connector comprises:

a) a slot formed in the plate through which the bolt extends, said slot extending in the same direction as the second path and being proportioned for slidable receipt of the bolt; and, b) a nut received on the bolt to secure the bolt against removal from the slot.

* * * * *